US007672137B2

(12) United States Patent
Kim et al.

(10) Patent No.: US 7,672,137 B2
(45) Date of Patent: Mar. 2, 2010

(54) PLASMA DISPLAY MODULE AND PLASMA DISPLAY APPARATUS INCLUDING THE SAME

(75) Inventors: Ki-Jung Kim, Suwon-si (KR); Myoung-Kon Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 644 days.

(21) Appl. No.: 11/378,076

(22) Filed: Mar. 17, 2006

(65) Prior Publication Data

US 2006/0214881 A1 Sep. 28, 2006

(30) Foreign Application Priority Data

Mar. 23, 2005 (KR) ..... 10-2005-0024265

(51) Int. Cl.
*H05K 5/00* (2006.01)

(52) U.S. Cl. ..... 361/752; 361/728

(58) Field of Classification Search ..... 361/681, 361/728, 752

See application file for complete search history.

(56) References Cited

U.S. PATENT DOCUMENTS

| | | | | |
|---|---|---|---|---|
| 3,895,361 | A | 7/1975 | Jones et al. | |
| 6,900,598 | B2 * | 5/2005 | Hibino et al. | 315/169.4 |
| 2002/0159240 | A1 * | 10/2002 | Watanabe et al. | 361/752 |
| 2004/0233132 | A1 * | 11/2004 | Choi et al. | 345/60 |
| 2005/0140588 | A1 * | 6/2005 | Lee et al. | 345/63 |
| 2005/0243106 | A1 * | 11/2005 | Bae et al. | 345/679 |
| 2007/0195494 | A1 * | 8/2007 | Miyoshi et al. | 361/681 |
| 2007/0258199 | A1 * | 11/2007 | Jeong | 361/681 |

FOREIGN PATENT DOCUMENTS

CN 1541385 A 10/2004

(Continued)

OTHER PUBLICATIONS

The Supplementary Search report by The European Patent Office on Oct. 16, 2006.

(Continued)

*Primary Examiner*—Dean A. Reichard
*Assistant Examiner*—Yuriy Semenenko
(74) *Attorney, Agent, or Firm*—Knobbe Martens Olson & Bear LLP

(57) ABSTRACT

A plasma display module that can optimize a position of an image board and connect an external image apparatus to a plasma display apparatus easily, and a plasma display apparatus including the plasma display module are disclosed. In one embodiment, the plasma display module includes: i) a chassis, ii) a plasma display panel supported by the chassis on a front portion of the chassis, the plasma display module comprising X electrodes and Y electrodes disposed parallel to each other, iii) an image board disposed on a rear portion of the chassis, and receiving and processing image signals input from an external device and iv) a Y electrode driving board disposed on the rear portion of the chassis, and electrically connected to the Y electrodes to apply the driving signals to the Y electrodes, wherein the Y electrode driving board and the image board are disposed on opposite sides of the chassis with respect to a center line crossing the chassis in a vertical direction.

15 Claims, 6 Drawing Sheets

FOREIGN PATENT DOCUMENTS

| | | | |
|---|---|---|---|
| EP | 1 065 650 | A2 | 1/2001 |
| EP | 1 065 694 | A1 | 1/2001 |
| EP | 1 355 338 | A2 | 10/2003 |
| EP | 1 622 118 | A2 | 2/2006 |
| KR | 1020040048698 | A | 6/2004 |
| KR | 1020040048698 | * | 10/2004 |

OTHER PUBLICATIONS

Office Action for European Application No. 06111450.0-2208 dated Jul. 31, 2008 by European Patent Office.

* cited by examiner

PLASMA DISPLAY MODULE AND PLASMA DISPLAY APPARATUS INCLUDING THE SAME

CROSS-REFERENCE TO RELATED PATENT APPLICATIONS

This application claims the benefit of Korean Patent Application No. 10-2005-0024265, filed on Mar. 23, 2005, in the Korean Intellectual Property Office, the disclosure of which is incorporated herein in its entirety by reference.

BACKGROUND OF THE INVENTION

1. Field of the Invention

The present invention relates to a plasma display module and a plasma display apparatus, and more particularly, to a plasma display module in which a position of an image board can be optimized and by which an external image apparatus can be connected to a plasma display apparatus including the plasma display module, and a plasma display apparatus including the plasma display module.

2. Description of the Related Technology

In general, a plasma display apparatus including a plasma display module is a display apparatus realizing a predetermined image by exciting phosphor materials using ultraviolet radiation generated from a gas discharge. Plasma display apparatuses are considered to be next generation flat panel display apparatuses since they can display high resolution images on a large screen. The plasma display module and apparatus display images using circuits driven at a relatively high voltage due to structural properties thereof. Therefore, many circuit boards are disposed on a rear portion of a chassis of the plasma display module.

FIG. 1 is a schematic plan view of an arrangement of various boards in a conventional plasma display module 100. Referring to FIG. 1, the conventional plasma display module 100 includes an image board 60, an X electrode driving board 20, a Y electrode driving board 10, an address electrode driving board 40, a logic board 50, and a power board 70.

The image board 60 is disposed on a rear portion of a chassis 5, and receives and processes image signals from external devices such as a DVD or a VCR. The X electrode driving board 20 is disposed on the rear portion of the chassis 5, and is electrically connected to X electrodes formed on a plasma display panel to apply driving signals to the X electrodes. In addition, the Y electrode driving board 10 is disposed on the rear portion of the chassis 5, and is electrically connected to Y electrodes formed on the plasma display panel to apply driving signals to the Y electrodes. The address electrode driving board 40 is disposed on the rear portion of the chassis 5, and is electrically connected to address electrodes formed on the plasma display panel to apply driving signals to the address electrodes. The logic board 50 is disposed on the rear portion of the chassis 5, and receives the image signals processed by the image board 60 to generate driving signals corresponding to the image signals. Then, the logic board 50 transmits the driving signals to the Y electrode driving board 10, the X electrode driving board 20, and the address electrode driving board 40. The power board 70 is disposed on the rear portion of the chassis 5, and supplies power to the circuit boards 10, 20 and 40-60.

The X electrode driving board 20, the Y electrode driving board 10, and the address electrode driving board 40 are disposed on left, right, and lower portions of the chassis 5, which are adjacent to the X electrodes, Y electrodes, and the address electrodes, in order to be connected to the X, Y, and address electrodes through the shorted distances. The power board 70 and the logic board 50 are located at a center portion of the chassis 5, and the image board 60 is located above the logic board 50 due to the arrangements of the Y, X and address electrode driving boards 10, 20, and 40.

The image board 60 includes input/output terminals for receiving/transmitting information from/to external apparatuses, for example, video tape recorders (VTRs), digital versatile disks (DVDs), or speakers. Since the image board 60 is disposed above the logic board 50 due to the arrangements of the various driving boards included in the plasma display module, the input/output terminals are exposed to the environment on a rear portion of the plasma display module 100.

Therefore, when a plasma display apparatus including the plasma display module 100 is used, the plasma display apparatus will need to be moved from a wall where it is hung for example, in order to connect external devices to the terminals of the plasma display apparatus. However, since the plasma display apparatus is large and heavy, it is difficult or inconvenient to move the plasma display apparatus for connecting the external devices to the apparatus. In addition, if the plasma display apparatus is hung on a wall, the plasma display apparatus should be separated from the wall in order to connect the external devices to the plasma display apparatus.

SUMMARY OF CERTAIN INVENTIVE ASPECTS

One aspect of the present invention provides a plasma display module in which a position of an image board is optimized and by which external image devices can be easily connected to a plasma display apparatus, and a plasma display apparatus including the plasma display module.

Another aspect of the present invention provides a plasma display module including: i) a chassis, ii) a plasma display panel supported by a front portion of the chassis, the plasma display panel comprising X electrodes and Y electrodes formed parallel to each other, and address electrodes crossing the X electrodes and the Y electrodes, wherein driving signals are applied at least to the Y electrodes and the address electrodes, iii) an image board located on a rear portion of the chassis, and configured to process image signals received from an external device and iv) a Y electrode driving board located on the rear portion of the chassis, and electrically connected to the Y electrodes to apply the driving signals to the Y electrodes, wherein the Y electrode driving board and the image board are located on opposite sides of the chassis with respect to a vertical line that substantially bisects the chassis.

In one embodiment, the X electrodes are connected to a ground voltage. In one embodiment, the plasma display module does not require an X electrode driving board configured to apply driving signals to the X electrodes. The image board may be disposed above or under the X electrode, in a case where the X electrode driving board is small.

The image board may include an input/output terminal, and the input/output terminal protrudes from a side of the plasma display module opposite to the side where the Y electrode driving board is disposed. Since the image board is biased to the side of the chassis, the input/output terminal can be disposed on a side of the rear cabinet. The arrangement of the input/output terminal allows for external devices to be easily connected to the input/output terminal without moving the plasma display apparatus, and thus, the connection of external devices can be simpler than that of the conventional art.

In addition, if the plasma display apparatus is hung on a wall, there is no need to separate the plasma display apparatus from the wall.

The plasma display module may further include a logic board located on the rear portion of the chassis, configured to receive the image signals processed by the image board to generate driving signals corresponding to the image signals, and transmitting the driving signals to the Y electrode driving board. The plasma display module may further include an address electrode driving board located on the rear portion of the chassis, configured to receive the driving signals generated by the logic board, and electrically connected to address electrodes to apply the driving signals to the address electrodes.

The plasma display module may further include a power board located on the rear portion of the chassis and configured to supply power to the image board, the Y electrode driving board, the address electrode driving board, and the logic board, wherein the power board and the logic board are located between the Y electrode driving board and the image board. The image board may include an input/output terminal, and the input/output terminal is located on a side of the plasma display module opposite to the side where the Y electrode driving board is located. The logic board may be located on the rear portion of the chassis under the power board and the address electrode driving board is located on the rear portion of the chassis under the logic board.

Another aspect of the present invention provides a plasma display apparatus including: i) a cabinet, ii) a chassis located in the cabinet, iii) a plasma display panel supported by a front portion of the chassis, the plasma display panel comprising X electrodes and Y electrodes formed parallel to each other, and address electrodes intersecting the X electrodes and the Y electrodes, wherein driving signals are applied at least to the Y electrodes and the address electrodes, iv) an image board located on a rear portion of the chassis, and configured to process image signals received from an external device, v) a logic board located on the rear portion of the chassis, and configured to receive the image signals processed by the image board to generate driving signals corresponding to the image signals, vi) a Y electrode driving board located on the rear portion of the chassis, and electrically connected to the Y electrodes to apply the driving signals from the logic board to the Y electrodes, vii) an address electrode driving board located on the rear portion of the chassis, configured to receive the driving signals generated by the logic board, and electrically connected to address electrodes to apply the driving signals to the address electrodes and viii) a power board located on the rear portion of the chassis and configured to supply power to the image board, the Y electrode driving board, the address electrode driving board, and the logic board, wherein the power board and the logic board are located between the Y electrode driving board and the image board.

The image board may include at least one of an input terminal and an output terminal, and the at least one terminal is located on a side of the plasma display module opposite to the side where the Y electrode driving board is located.

Another aspect of the invention provides a plasma display module, comprising: a chassis having first and second surfaces opposing each other, wherein the first surface of the chassis is directed toward a plasma display panel and an image board located on the second surface of the chassis, wherein the image board includes at least one of an input terminal and an output terminal, and wherein the at least one terminal is located adjacent to an edge of the second surface of the chassis.

In one embodiment, the at least one terminal is located on one of sides of the second surface of the chassis. In another embodiment, the at least one terminal is located on a portion of the chassis, wherein an external device can be connected to the portion of the chassis without moving a plasma display apparatus including the plasma display module. In one embodiment, the plasma display panel comprises X electrodes and Y electrodes formed parallel to each other, wherein the plasma display module further includes a Y electrode driving board located on the second surface of the chassis and configured to drive the Y electrodes. In one embodiment, the Y electrode driving board and the image board are located on opposite sides of the second surface with respect to a vertical line substantially bisecting the second surface of the chassis. In one embodiment, the module does not require an X electrode driving board configured to apply driving signals to the X electrodes. In one embodiment, the image board is configured to communicate image signals with an external device via the at least one terminal. In one embodiment, the external device includes one of the following: a DVD, a VCR, a TV and speakers.

BRIEF DESCRIPTION OF THE DRAWINGS

Embodiments of the present invention will be described with reference to the attached drawings.

DETAILED DESCRIPTION OF CERTAIN INVENTIVE EMBODIMENTS

Figure 1:
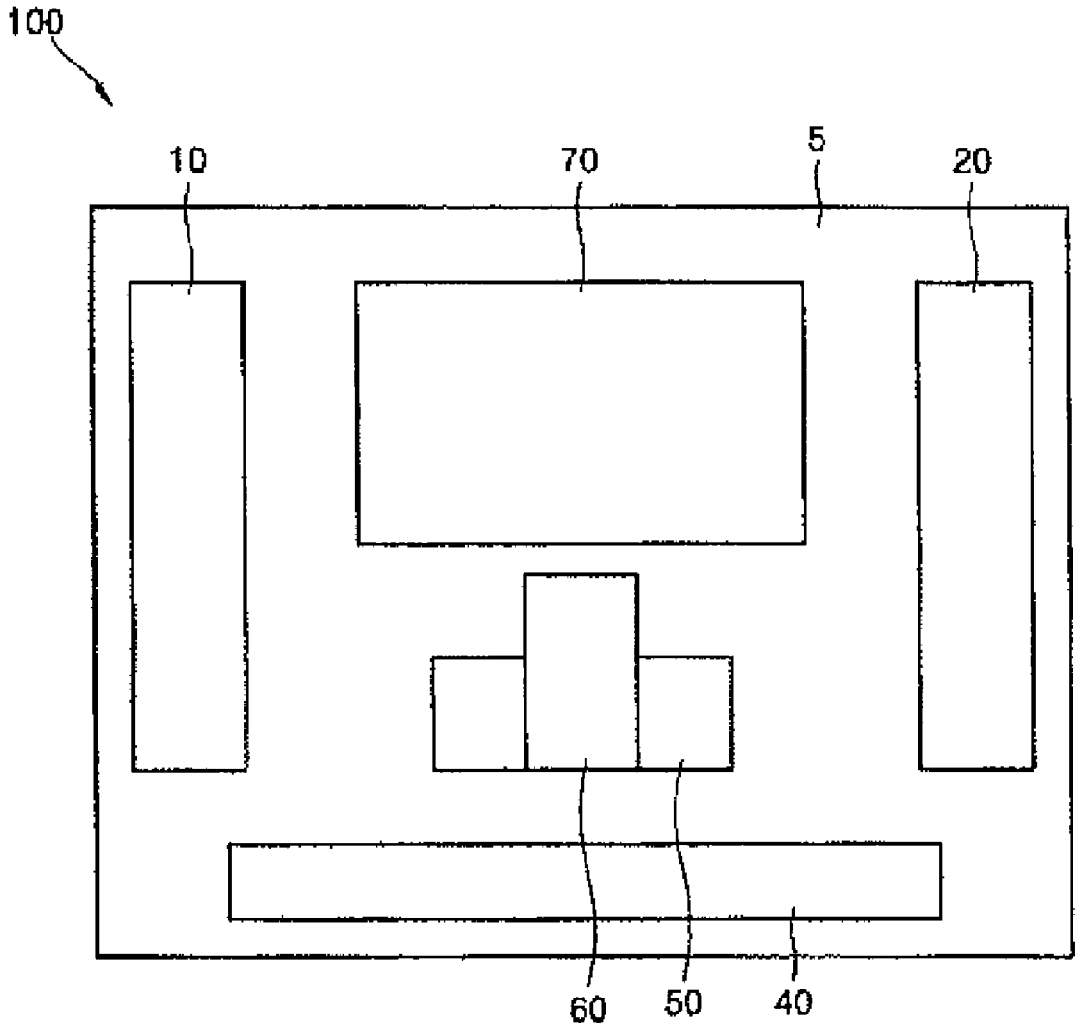
PRIOR ART FIG. 1
FIG. 1 is a schematic plan view of an arrangement of various boards in a conventional plasma display module.

Hereinafter, embodiments of the present invention will be described in greater detail with reference to the attached drawings. Like reference numerals in the drawings denote like elements.

Figure 2:
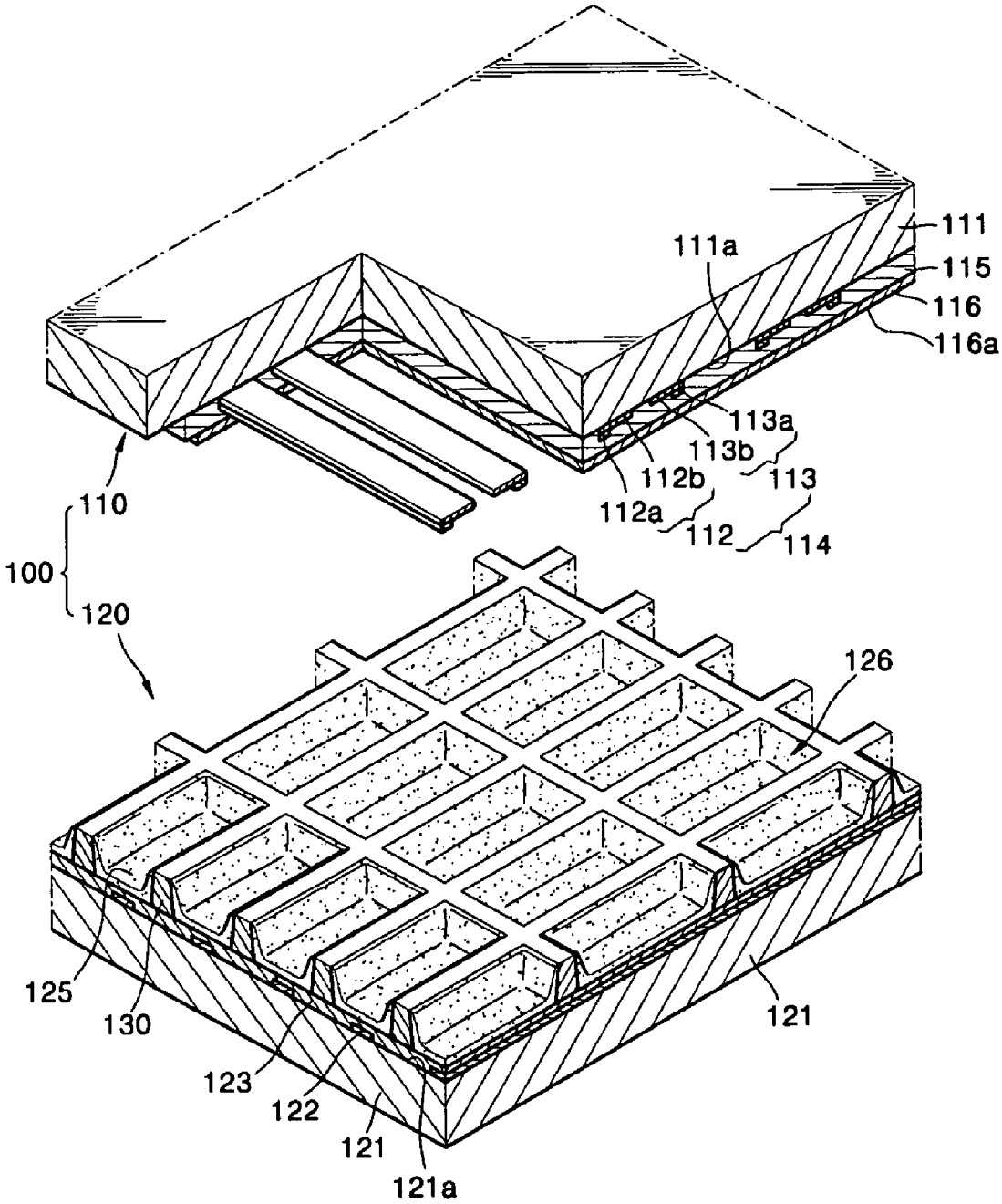
FIG. 2 is an exploded perspective view of a plasma display panel according to an embodiment of the present invention.

FIG. 2 is an exploded perspective view of a plasma display panel 100 according to an embodiment of the present invention. Referring to FIG. 2, the plasma display panel 100 includes a front panel 110 and a rear panel 120. The front panel 110 includes a front substrate 111, and the rear panel 120 includes a rear substrate 121. The plasma display panel 100 includes barrier ribs 130 disposed between the front substrate 111 and the rear substrate 121, and defining discharge cells 126, in which discharge occurs for displaying images.

In one embodiment, the front panel 110 includes pairs of electrodes 114, each of which includes an X electrode 113 and a Y electrode 112 disposed on the front substrate 111. In addition, the front panel 110 includes a front dielectric layer 115 that is disposed on the front substrate 111 and covering the Y electrodes 112 and the X electrodes 113. The Y and X electrodes 112 and 113, respectively, include bus electrodes 112*a* and 113*a* formed of, for example, a metal material for improving an electric conductivity, and transparent electrodes 112*b* and 113*b* formed of a transparent conductive material such as an indium tin oxide (ITO). In addition, a front protective layer 116 is formed on a rear surface of the front dielectric layer 115 for protecting the front dielectric layer 115.

The rear panel 120 includes the rear substrate 121, and a rear dielectric layer 123 formed on the rear substrate 121. Address electrodes 122 that intersect the Y and X electrodes 112 and 113 at the discharge cells 126 are disposed on the rear dielectric layer 123. In addition, the barrier ribs 130 defining the discharge cells 126 are disposed on the rear dielectric layer 123, and phosphor layers 125 are disposed in the discharge cells 126 that are defined by the barrier ribs 130.

The front panel 110 and the rear panel 120 may be coupled with each other and sealed using a coupling member such as a frit (not shown). Meanwhile, a discharge gas including one of Xe, Ne, He, and Ar, or a mixed gas thereof is filled in the discharge cells 126.

Figure 3:
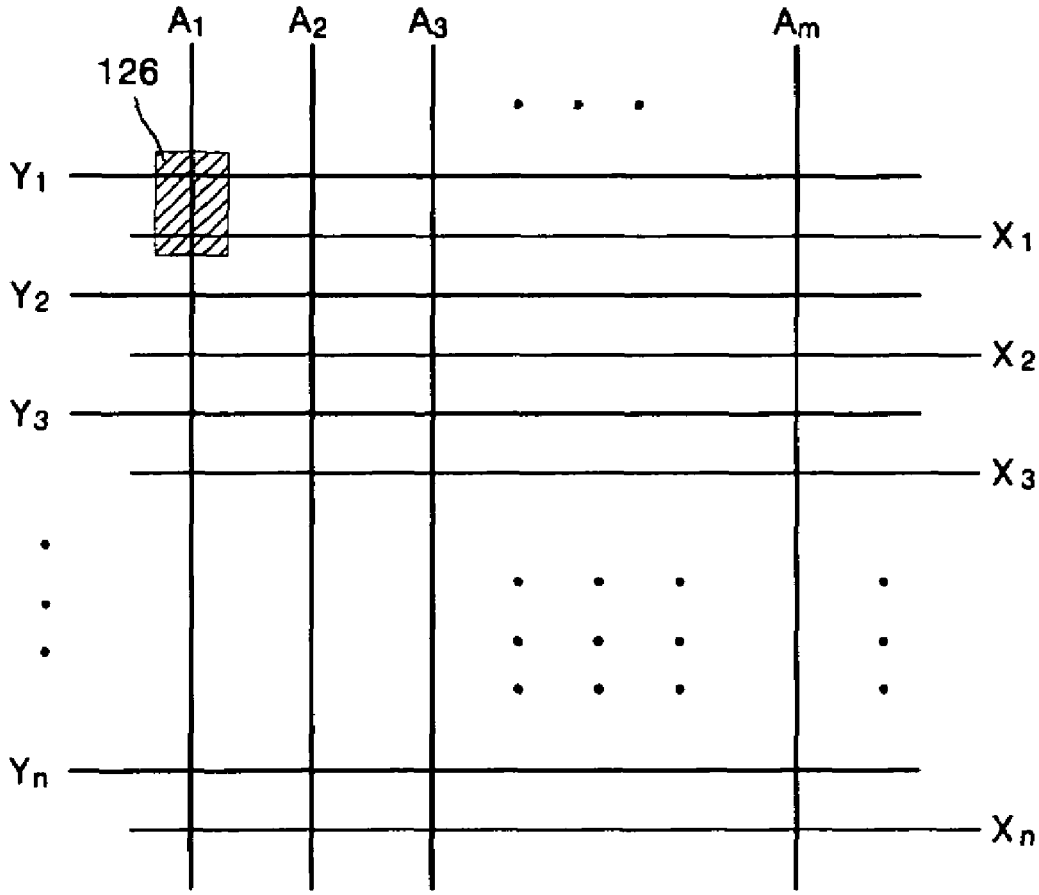
FIG. 3 is a schematic plan view of an arrangement of electrodes in a plasma display panel according to an embodiment of the present invention.

FIG. 3 is a schematic plan view of an arrangement of electrodes in a plasma display panel according to an embodiment of the present invention. Referring to FIG. 3, Y electrodes Y1, . . . , Yn and X electrodes X1, . . . , Xn are disposed to be parallel to each other. Address electrodes A1, A2, . . . , Am intersect the Y and X electrodes Y1, . . . , Yn, and X1, . . . , Xn at the discharge cells 126.

An address display separation (ADS) method of driving the plasma display panel according to an embodiment of the present invention will be described with reference to FIG. 3.

In one embodiment, the plasma display panel 100 is driven by the ADS method. In general, a discharge occurs in each of the discharge cells 126 formed in the plasma display panel 100 in order to display images. Then, wall charges of the discharge cells 126 or amounts of charged particles in the discharge cells 126 become different from each other, and thus, it is difficult to control the discharge occurring in the discharge cells 126 uniformly using the same method. Therefore, in one embodiment, a high voltage is applied to the entire discharge cells 126 so that the discharge can occur simultaneously in all of the discharge cells 126, and thus, the wall charges existing in the discharge cells 126 are removed and the charged particles in the discharge cells 126 become constant. The above process is referred to as a reset discharge.

After generating the reset discharge, an address discharge is generated. The address discharge is generated by applying a pulse voltage to the electrodes intersecting each other, that is, a Y electrode 112 and an address electrode 122, to accumulate the charged particles that are generated by the discharge and generate wall charges in the discharge cell 126 which should be selected for displaying images. The address discharge accumulates the wall charges on inner surfaces of the discharge cell 126 in order to select the discharge cell 126 to display images, and then, a sustain discharge can occur due to the accumulated wall charges.

After generating the address discharge, the sustain discharge occurs in order to display the image. In the discharge cell 126 selected by the address discharge, sustain voltages are alternately applied to the pair of electrodes 114 to represent a certain gradation and to emit visible light from the discharge cell 126, and thus, the image is displayed on the plasma display panel 100. When voltages lower than a discharge initiating voltage are applied alternately to the pairs of electrodes 114 corresponding to the discharge cells 126, the voltages exceed the discharge initiating voltages in the discharge cells 126, in which the address discharge occurs, due to the wall charges accumulated in the discharge cells 126, and the sustain discharge occurs in the discharge cells 126. Thus, visible light is emitted from the discharge cells 126, in which the address discharge occurs. In addition, a predetermined gradation can be represented by the sustain discharge.

Figure 4:
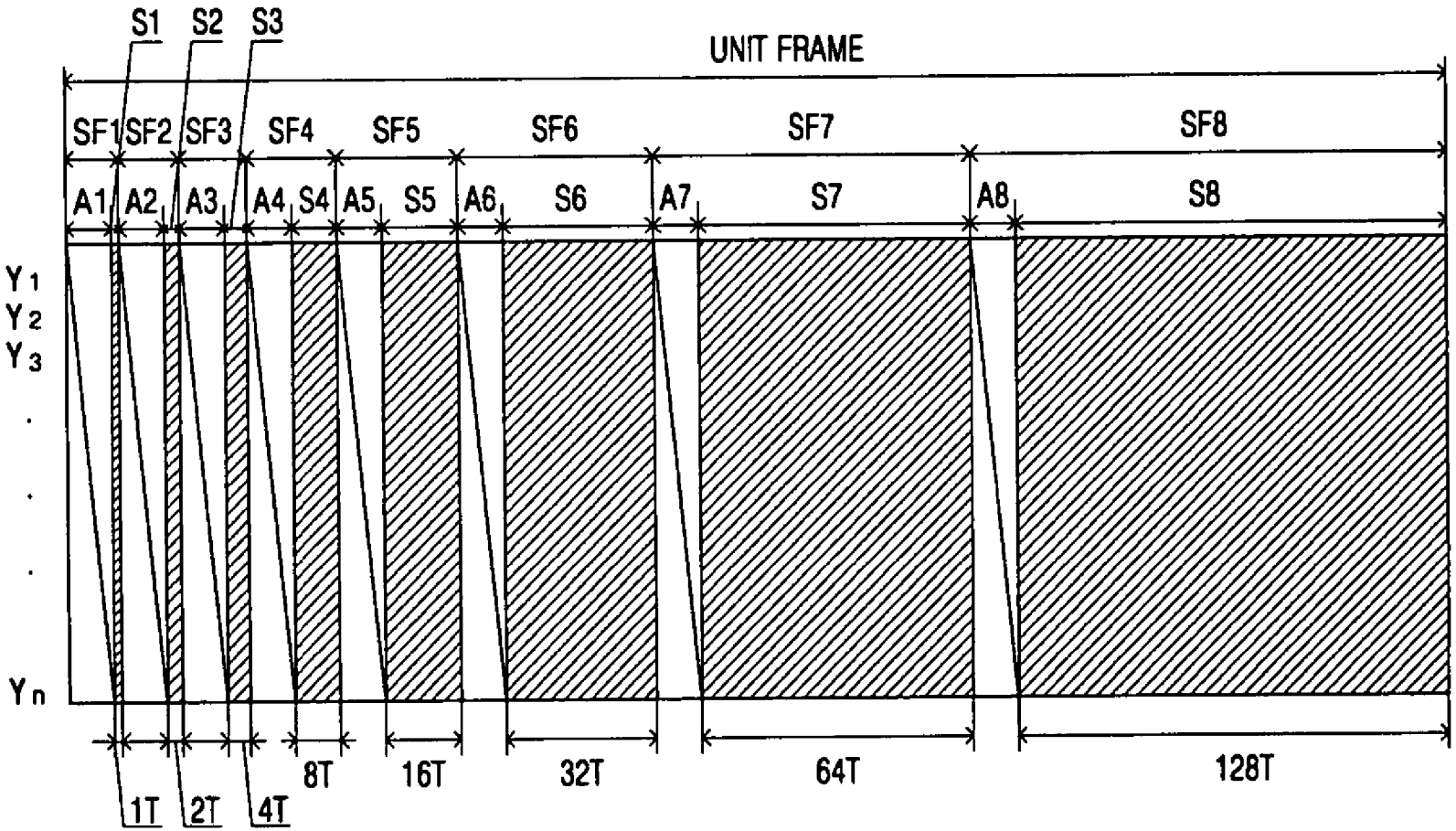
FIG. 4 is a diagram for illustrating a method of driving a plasma display panel according to an embodiment of the present invention.

Processes of displaying images on the plasma display panel 100 using the reset discharge, the address discharge, and the sustain discharge will be described with reference to FIG. 4. FIG. 4 is a diagram for illustrating a method of driving a plasma display panel according to an embodiment of the present invention. In one embodiment, in order to display an image on the plasma display panel 100 corresponding to an external image signal, each of a plurality of image frames represents a gray scale of, for example, 256 gradations, and each image frame is separated timely from each other. That is, 60 image frames, each of which independently represents the gray scale, can display a moving picture for a second. In one embodiment, the plasma display panel 100 emits the visible radiation by the wall charges accumulated in the discharge cells during the address discharge, and the sustain discharge generated by the wall charges.

In one embodiment, in order to display the image in consideration of the characteristics of the plasma display panel, one image frame can be divided into 8 sub-fields (SF), that is, a first SF through an eighth SF, in which the reset discharge, the address discharge, and the sustain discharge are repeatedly generated. In addition, 60 image frames continuously display images for realizing the moving picture for one second using the ADS method.

Figure 5:
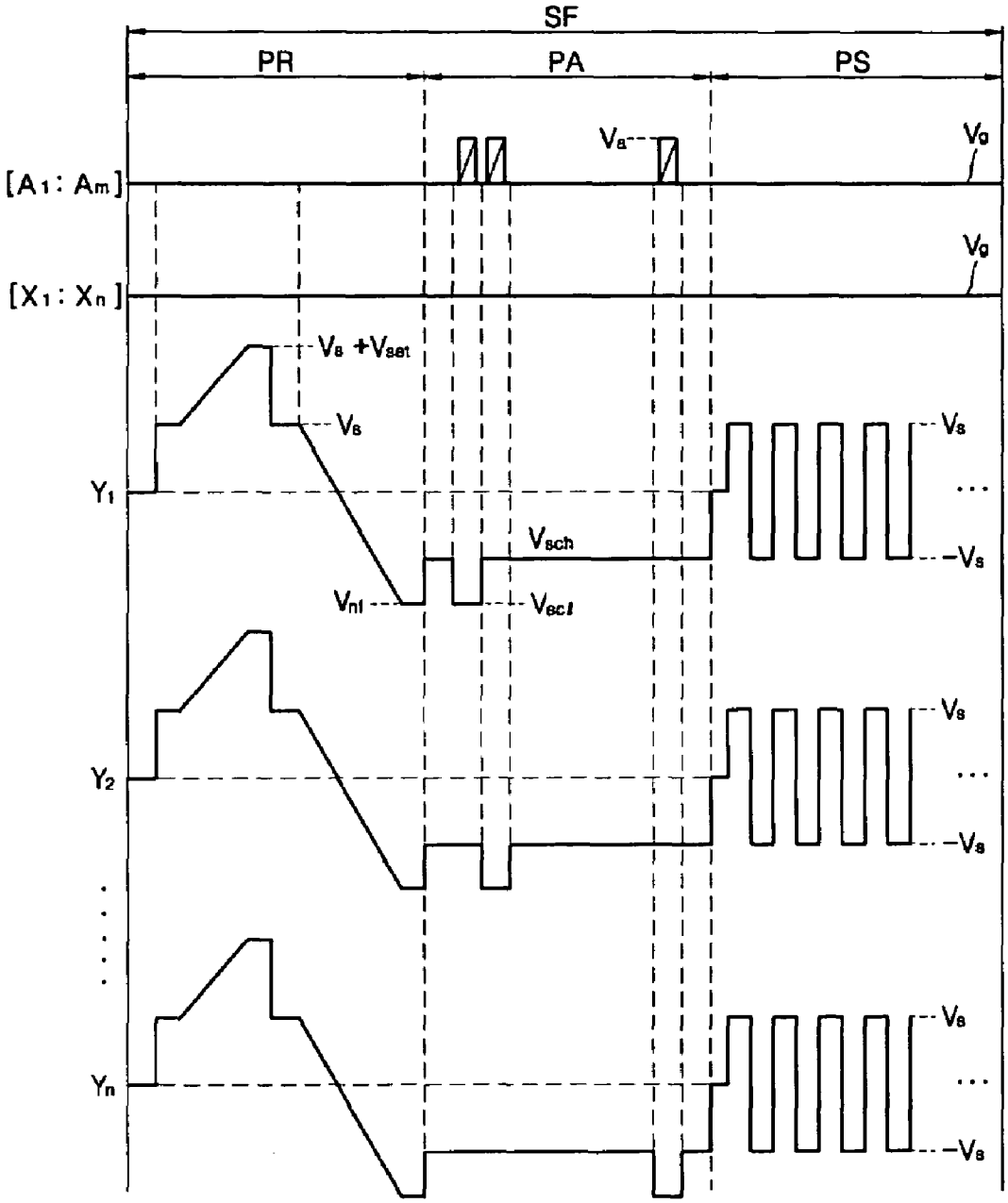
FIG. 5 is a timing diagram for illustrating a driving signal of the plasma display panel according to an embodiment of the present invention.

FIG. 5 is a timing diagram for illustrating a driving signal of the plasma display panel according to an embodiment of the present invention. Referring to FIG. 5, each of the SFs includes a reset period (PR), an address period (PA), and a sustain period (PS).

In the reset period, a ground voltage Vg is applied to the Y electrodes Y1, . . . , Yn. Then, a sustain voltage Vs, that is, a first voltage, is rapidly applied to the Y electrodes Y1, . . . , Yn, and then, a rising ramp signal is applied to rise the voltage from the sustain voltage (Vs) as much as a predetermined voltage (Vset), thus reaching the highest rising voltage (Vs+Vset). Since the rising ramp signal having a slow gradient is applied, a weak discharge occurs, and negative charges are accumulated around the Y electrodes Y1, . . . , Yn. In one embodiment, since the driving signal is not supplied from an X driving unit that supplies driving signals to the X electrodes X1, . . . , Xn as in the conventional PDP device, a falling gradient of the driving signal is sharper than that of the conventional driving signal. Therefore, a fourth voltage Vnf, that is, the lowest falling voltage, is higher than that of the conventional art. The discharge occurs by applying the falling gradient of the driving signal to the Y electrodes, Y1, . . . , Yn. Then, some of the negative charges accumulated around the Y electrodes Y1, . . . , Yn are emitted during the discharge. Consequently, the negative charges enough to cause the address discharge remain around the Y electrodes Y1, . . . , Yn. The ground voltage Vg is applied to the X electrodes X1, . . . , Xn and the address electrodes A1, . . . , Am.

Next, in the address period (PA), a scan high voltage Vsch, that is, a fifth voltage, is applied to the Y electrodes Y1, . . . , Yn in order to select the discharge cells 126 to be discharged, and then, scan pulses of a scan low voltage Vscl, that is, a sixth voltage, are sequentially applied to the Y electrodes Y1, . . . , Yn. In addition, display data signals of an address voltage Va, that is, a seventh voltage, are applied to the address electrodes A1, . . . , Am corresponding to the scan pulses. The ground voltage Vg is continuously applied to the X electrodes X1, . . . , Xn. The address discharge is generated by the address voltage Va, the scan low voltage Vscl, the negative charges around the Y electrodes Y1, . . . , Yn, and positive charges around the address electrodes A1, . . . , Am. After the address discharge, the positive charges are accumulated around the Y electrodes Y1, . . . , Yn, and the negative charges are accumulated around the X electrodes X1, . . . , Xn.

In the sustain period (PS), sustain pulses having a positive first voltage Vs and a negative first voltage −Vs are applied to the Y electrodes Y1, . . . , Yn, and the ground voltage Vg is applied to the X electrodes X1, . . . , Xn. The positive charges around the Y electrodes Y1, . . . , Yn are moved toward the X electrodes X1, . . . , Xn, and the negative charges accumulated on the X electrodes X1, . . . , Xn are moved toward the Y electrodes Y1, . . . , Yn by the positive first voltage Vs applied to the Y electrodes Y1, . . . , Yn, and then, the charges collide with the discharge gas to generate the discharge and visible rays are emitted. In addition, when the negative first voltage −Vs is applied to the Y electrodes Y1, . . . , Yn, the negative charges accumulated on the Y electrodes Y1, . . . , Yn are moved to the X electrodes X1, . . . , Xn and the positive charges accumulated on the X electrodes X1, . . . , Xn are moved to the Y electrodes Y1, . . . , Yn, and the discharge is generated again. The positive first voltage Vs and the negative second voltage −Vs are applied alternately to the Y electrodes Y1, . . . , Yn, and the ground voltage Vg is applied to the X electrodes X1, . . . , Xn to display gray scales on the screen of the plasma display panel 100.

As described above, since the ground voltage Vg is applied to the X electrodes X1, . . . , Xn during the discharge, there is no need to connect an additional driving circuit to the X electrodes X1, . . . , Xn. Therefore, an X electrode driving board is not required in one embodiment of the present invention unlike the conventional art. Thus, an image board can be disposed in the space where the X electrode driving board 10 is disposed in the conventional plasma display module 100 of FIG. 1.

Figure 6:
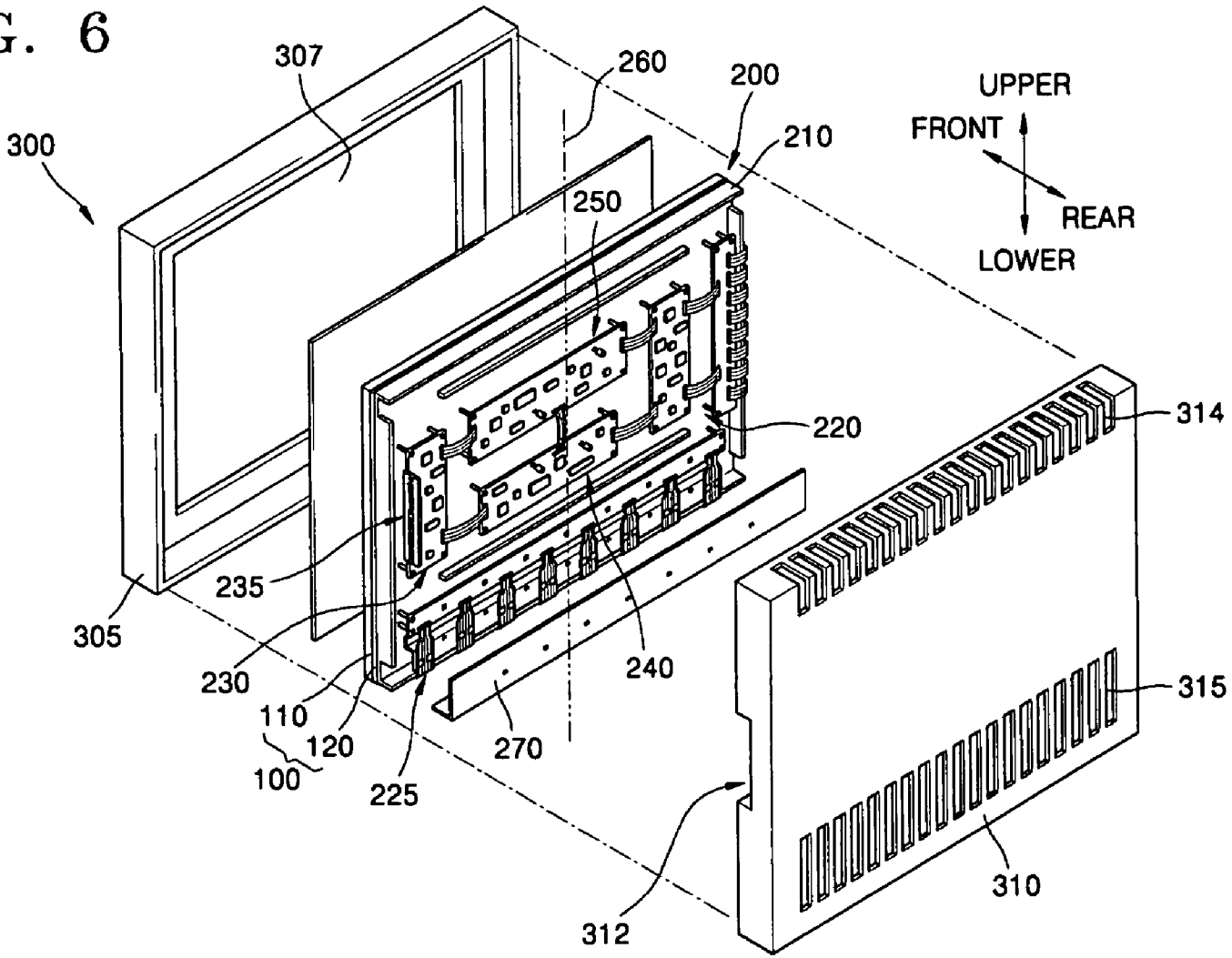
FIG. 6 is an exploded perspective view of a plasma display apparatus according to an embodiment of the present invention.

FIG. 6 is an exploded perspective view of a plasma display apparatus 300 according to an embodiment of the present invention. Referring to FIG. 6, the plasma display apparatus 300 includes a front cabinet 305 having a window 307 in a front portion thereof, a plasma display module 200 including the plasma display panel 100 disposed on a rear portion of the front cabinet 305 to correspond to the window 307, and a rear cabinet 310 coupled to the front cabinet 305 while interposing the plasma display module 200 therebetween.

In one embodiment, the rear cabinet 310 includes air inlets 315 and air outlets 314 for discharging heat generated by the plasma display panel 100. In another embodiment, the air inlets 315 and the air outlets 314 are not necessarily formed on the rear cabinet 310. However, since viewers mainly watch the front portion of the plasma display apparatus 300, it may be advantageous that the air inlets and outlets 315 and 314 are disposed on the rear cabinet 310.

The plasma display module 200 includes a chassis 210, the plasma display panel 100 supported by a front portion of the chassis 210, an image board 230 disposed on a rear portion of the chassis 210 for receiving image signals input from outside and processing the image signals, and a Y electrode driving board 220 disposed on the chassis 210 and electrically connected to the Y electrodes 112 (refer to FIG. 2) to apply driving signals to the Y electrodes 112. In one embodiment, the Y electrode driving board 220 and the image board 230 are disposed on opposite sides of the chassis 210 with respect to a center line 260 therebetween crossing the chassis 210 in a vertical direction.

In this embodiment, the plasma display module 200 includes a logic board 240 disposed on the rear portion of the chassis 210 and receiving the image signals processed by the image board 230 to generate driving signals corresponding to the image signals and transmit the driving signals to the Y electrode driving board 220. Furthermore, the plasma display module 200 includes an address electrode driving board 225 receiving the driving signals generated by the logic board 240 and electrically connected to the address electrodes 122 to apply the driving signals to the address electrodes 122, and a power board 250 disposed on the rear portion of the chassis 210 and supplying power to the circuit boards 230, 220, 225 and 240.

The power board 250 and the logic board 240 may be disposed between the Y electrode driving board 220 and the image board 230. In one embodiment, since the Y electrode driving board 220 is electrically connected to the Y electrodes 112, the Y electrode driving board 220 is adjacent to terminals of the Y electrodes 112. In one embodiment, since the plasma display module 200 does not include an X electrode driving board, the image board 230 can be located on a portion where a conventional X electrode driving board is located.

Although the drawings illustrate cases where an X electrode driving board is not included, the present invention is not limited thereto. That is, the plasma display module and the plasma display apparatus including an X electrode driving board may be within the scope of the present invention, as long as the input and output terminals 235 of the image board 230 are located near an edge of the chassis (e.g., sides or top of the chassis) so that external devices such as a DVD, a VCR, a TV or speakers can be easily connected to the input/output terminals 235 without moving the plasma display apparatus. In such an embodiment, the X electrode driving board (not shown) and the Y electrode driving board 220 are disposed on opposite sides of the chassis 210 with respect to the center line 260 in the vertical direction of the chassis. In this embodiment, the image board 230 may be disposed on the rear portion of the chassis under or above the X electrode driving board.

In addition, the logic board 240 may be disposed on the rear portion of the chassis 210, and the address electrode driving board 225 may be disposed on the rear portion of the chassis 210 under the logic board 240. In this embodiment, since the address electrode driving board 225 is electrically connected to the address electrodes 122, the address electrode driving board 225 is adjacent to the address electrodes 122.

The image board 230 may include an input/output terminal 235 for connecting to external devices, for example, DVDs, VTRs, TVs and speakers. Since the image board 230 is biased to the side of the chassis 210, the input/output terminal 235 can be disposed on a side 312 of the rear cabinet 310.

In one embodiment, the arrangement of the input/output terminal 235 allows for external devices to be easily connected to the input/output terminal 235 without moving the plasma display apparatus 300, and thus, the connection of external devices can be simpler than that of the conventional art. In addition, if the plasma display apparatus 300 is hung on a wall, there is no need to separate the plasma display apparatus 300 from the wall.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A plasma display module, comprising:

a chassis;

a plasma display panel supported by a front portion of the chassis, the plasma display panel comprising X electrodes and Y electrodes formed parallel to each other, and address electrodes intersecting the X electrodes and the Y electrodes, wherein driving signals are applied at least to the Y electrodes and the address electrodes, wherein the X electrodes are connected to a ground voltage, and wherein the plasma display module does not require an X electrode driving board configured to apply driving signals to the X electrodes;

an image board located on a rear portion of the chassis, and configured to process image signals received from an external device; and a Y electrode driving board located on the rear portion of the chassis, and electrically connected to the Y electrodes to apply the driving signals to the Y electrodes, wherein the Y electrode driving board and the image board are located on opposite sides of the chassis with respect to a vertical line that substantially bisects the chassis.

2. The plasma display module of claim 1, further comprising: a logic board located on the rear portion of the chassis, configured to receive the image signals processed by the image board to generate driving signals corresponding to the image signals, and transmit the driving signals to the Y electrode driving board.

3. The plasma display module of claim 2, further comprising: an address electrode driving board located on the rear portion of the chassis, configured to receive the driving signals generated by the logic board, and electrically connected to address electrodes to apply the driving signals to the address electrodes.

4. The plasma display module of claim 3, further comprising: a power board located on the rear portion of the chassis and configured to supply power to the image board, the Y electrode driving board, the address electrode driving board, and the logic board, wherein the power board and the logic board are located between the Y electrode driving board and the image board.

5. The plasma display module of claim 4, wherein the image board comprises an input/output terminal, and the input/output terminal is located on a side of the plasma display module opposite to the side where the Y electrode driving board is located.

6. The plasma display module of claim 4, wherein the logic board is located on the rear portion of the chassis under the power board and the address electrode driving board is located on the rear portion of the chassis under the logic board.

7. A plasma display apparatus, comprising:

a cabinet;

a chassis located in the cabinet;

a plasma display panel supported by a front portion of the chassis, the plasma display panel comprising X electrodes and Y electrodes formed parallel to each other, and address electrodes intersecting the X electrodes and the Y electrodes, wherein driving signals are applied at least to the Y electrodes and the address electrodes, wherein the X electrodes are connected to a ground voltage, and wherein the plasma display apparatus does not require an X electrode driving board configured to apply driving signals to the X electrodes;

an image board located on a rear portion of the chassis, and configured to process image signals received from an external device;

a logic board located on the rear portion of the chassis, and configured to receive the image signals processed by the image board to generate driving signals corresponding to the image signals;

a Y electrode driving board located on the rear portion of the chassis, and electrically connected to the Y electrodes to apply the driving signals from the logic board to the Y electrodes;

an address electrode driving board located on the rear portion of the chassis, configured to receive the driving signals generated by the logic board, and electrically connected to address electrodes to apply the driving signals to the address electrodes; and a power board located on the rear portion of the chassis and configured to supply power to the image board, the Y electrode driving board, the address electrode driving board, and the logic board;

wherein the power board and the logic board are located between the Y electrode driving board and the image board.

8. The plasma display apparatus of claim 7, wherein the image board comprises at least one of an input terminal and an output terminal, and wherein the at least one of the input and output terminals is located on a side of the plasma display module opposite to the side where the Y electrode driving board is located.

9. The plasma display module of claim 1, wherein the external device includes one of the following: a DVD, a VCR and a TV.

10. A plasma display module, comprising:

a chassis having first and second surfaces opposing each other, wherein the first surface of the chassis is directed toward a plasma display panel;

an image board located on the second surface of the chassis, wherein the image board includes at least one of an input terminal and an output terminal, and wherein the at least one of the input and output terminals is located adjacent to an edge of the second surface of the chassis;

X electrodes and Y electrodes formed substantially parallel to each other, wherein the X electrodes are connected to a ground voltage, and wherein the plasma display module does not require an X electrode driving board configured to apply driving signals to the X electrodes; and a Y electrode driving board located on the second surface of the chassis and configured to drive the Y electrodes.

11. The plasma display module of claim 10, wherein the at least one of the input and output terminals is located on one of sides of the second surface of the chassis.

12. The plasma display module of claim 10, wherein the at least one of the input and output terminals is located on a portion of the chassis, and wherein an external device can be connected to the portion of the chassis without moving a plasma display apparatus including the plasma display module.

13. The plasma display module of claim 10, wherein the Y electrode driving board and the image board are located on opposite sides of the second surface with respect to a vertical line substantially bisecting the second surface of the chassis.

14. The plasma display module of claim 10, wherein the image board is configured to communicate image signals with an external device via the at least one of the input and output terminals.

15. The plasma display module of claim 14, wherein the external device includes one of the following: a DVD, a VCR, a TV and speakers.

* * * * *